US006352162B1

(12) United States Patent
Yang et al.

(10) Patent No.: US 6,352,162 B1
(45) Date of Patent: Mar. 5, 2002

(54) INTERLOCKING BOOKENDS

(75) Inventors: John S. Yang, Northbrook; Dale A. Eick, Mundelein, both of IL (US)

(73) Assignee: Block and Company, Inc., Wheeling, IL (US)

( * ) Notice: Subject to any disclaimer, the term of this patent is extended or adjusted under 35 U.S.C. 154(b) by 0 days.

(21) Appl. No.: 09/626,174

(22) Filed: Jul. 27, 2000

(51) Int. Cl.[7] ..... A47B 65/00

(52) U.S. Cl. ..... 211/43; 248/441.1; D19/34.1

(58) Field of Search ..... 211/42–43, 194, 211/184, 183, 175, 126.6, 132.1; 108/60–61; 281/15.1; D19/34.1–34.5; 248/441.1, 448–450, 460

(56) References Cited

U.S. PATENT DOCUMENTS

| | | | | | |
|---|---|---|---|---|---|
| 1,598,467 | A | * | 8/1926 | Weeks | 211/43 |
| 1,750,575 | A | | 3/1930 | Cubberley | |
| 1,750,576 | A | | 3/1930 | Cubberley | |
| 3,425,565 | A | * | 2/1969 | Sprenger | 211/43 |
| 3,455,462 | A | * | 7/1969 | Morgan | |
| 3,844,415 | A | * | 10/1974 | Heimann | 211/43 |
| D241,295 | S | | 9/1976 | Entin | |
| 4,099,626 | A | * | 7/1978 | Magnussen, Jr. | 211/194 |
| 4,199,070 | A | * | 4/1980 | Magnussen, Jr. | 211/194 |
| D262,336 | S | | 12/1981 | Barnstone | |
| 4,358,019 | A | * | 11/1982 | Garner | 211/42 |
| 4,423,913 | A | * | 1/1984 | Lee | 211/194 |
| 4,496,127 | A | | 1/1985 | Nelson | |
| D286,302 | S | | 10/1986 | Shugar | |
| 4,637,632 | A | | 1/1987 | Rubash et al. | |
| D302,025 | S | | 7/1989 | Shugar | |
| 4,856,658 | A | | 8/1989 | Novak | |
| 4,874,099 | A | | 10/1989 | Arnott et al. | |
| 4,938,365 | A | * | 7/1990 | Conway et al. | 211/50 |
| 4,942,967 | A | * | 7/1990 | Schneider | 211/194 |
| 5,183,163 | A | | 2/1993 | Slaiken | |
| 5,201,428 | A | | 4/1993 | Pasinski et al. | |
| 5,205,420 | A | * | 4/1993 | Petryszak | 211/43 |
| D351,616 | S | | 10/1994 | Troy et al. | |
| D351,618 | S | | 10/1994 | Troy et al. | |
| 5,971,165 | A | * | 10/1999 | Levins | 211/43 |
| 6,142,321 | A | * | 11/2000 | West | 211/153 |
| 6,206,206 | B1 | * | 3/2001 | Saylor et al. | 211/46 |

OTHER PUBLICATIONS

Japanese Office Depot Catalog, at least as early as Jul. 27, 1999, p. 209, prod. No. 370.

* cited by examiner

*Primary Examiner*—Daniel P. Stodola
*Assistant Examiner*—Jennifer E. Novsad
(74) *Attorney, Agent, or Firm*—Cook, Alex, McFarron, Manzo, Cummings & Mehler, Ltd.

(57) ABSTRACT

A book holder system comprising first and second book ends, each bookend having a substantially planar vertical surface for engaging at least one object such as a book, or the like, that is to be held between the bookends. Each bookend has a horizontal leg that underlies the objects to be held between the vertical surfaces. The horizontal legs of the first and second bookends have complimentary-shaped interlocking projections and recesses. The projections permit disengagement of the first bookend from the second bookend only when the first and second bookends are moved in a vertical direction with respect to each other.

8 Claims, 3 Drawing Sheets

INTERLOCKING BOOKENDS

The present invention relates to a system for containing or holding books or the like and, more particularly for a book holder system comprising a pair of interlocking bookends.

BACKGROUND OF THE INVENTION

It is well known to provide a book holder system comprising two book ends that are either L-shaped or an inverted T-shape. One leg of the L or the crossbar of the T is placed under the books or other materials that are to be held between the bookends, and the space between the two bookends can be varied to accommodate different volumes of material to be held therebetween.

Bookends of this type are advantageous because they are lightweight, take up little shelf space, and can be made relatively inexpensive. One problem common to such bookends is that, after time, they tend to creep apart and thus do not securely hold the material placed therebetween. This is particularly true when the materials to be held between the bookends are somewhat materials to be held between the bookends are somewhat compressible. Various methods have been employed to prevent the bookends from creeping apart, the best known being the employment of non-skid pads on the bottom of the horizontal legs of the bookends. Such pads increase the frictional resistance between the bookend and the surface on which it is placed.

Other methods have been provided for interlocking the bookends. See, e.g., U.S. Pat. No. 4,637,632 to Rubash, et al., and U.S. Pat. No. 5,183,163 to Slaiken. While the bookends of these patents do have features that serve to interlock the bookends, they too have various drawbacks. Primarily, the bookends are not identical in configuration and have a male and female member. This results in increased manufacturing costs because different and/or additional steps are required to make the two different members.

Accordingly, it is an object of the present invention to provide a book holder system that provides for interlocking between the two bookends comprising the system.

It is a further object to provide a book holder system which is economical and simple in its manufacture.

Further, it is an object of the present invention to provide a book holder system in which the two bookends are interchangeable with each other.

SUMMARY OF THE INVENTION

These objects, as well as others which will become apparent upon reference to the following detailed description and accompanying drawings, are met by a book holder system that comprises first and second book ends, each bookend having a substantially planar vertical surface for engaging at least one object such as a book, or the like, that is to be held between the bookends. Each bookend has a horizontal leg that underlies the objects to be held between the vertical surfaces. The horizontal legs of the first and second bookends have complimentary-shaped interlocking projections and recesses. The projections permit disengagement of the first bookend from the second bookend only when the first and second bookends are moved in a vertical direction with respect to each other.

The projections are symmetrical in shape and have a narrow neck portion and a relatively larger head portion, while the recesses are also symmetrical in shape and have a narrow mouth and relatively larger interior. Consequently, the heads of the projection are larger than the mouths of the recesses and cannot be slid out of the recesses unless the bookends are moved in a vertical direction relative to each other. The projections and recesses may take a variety of shapes, such as a curvilinear shape, a T-shape, or a dovetail-shape.

DETAILED DESCRIPTION OF THE PREFERRED EMBODIMENTS

Figure 1:
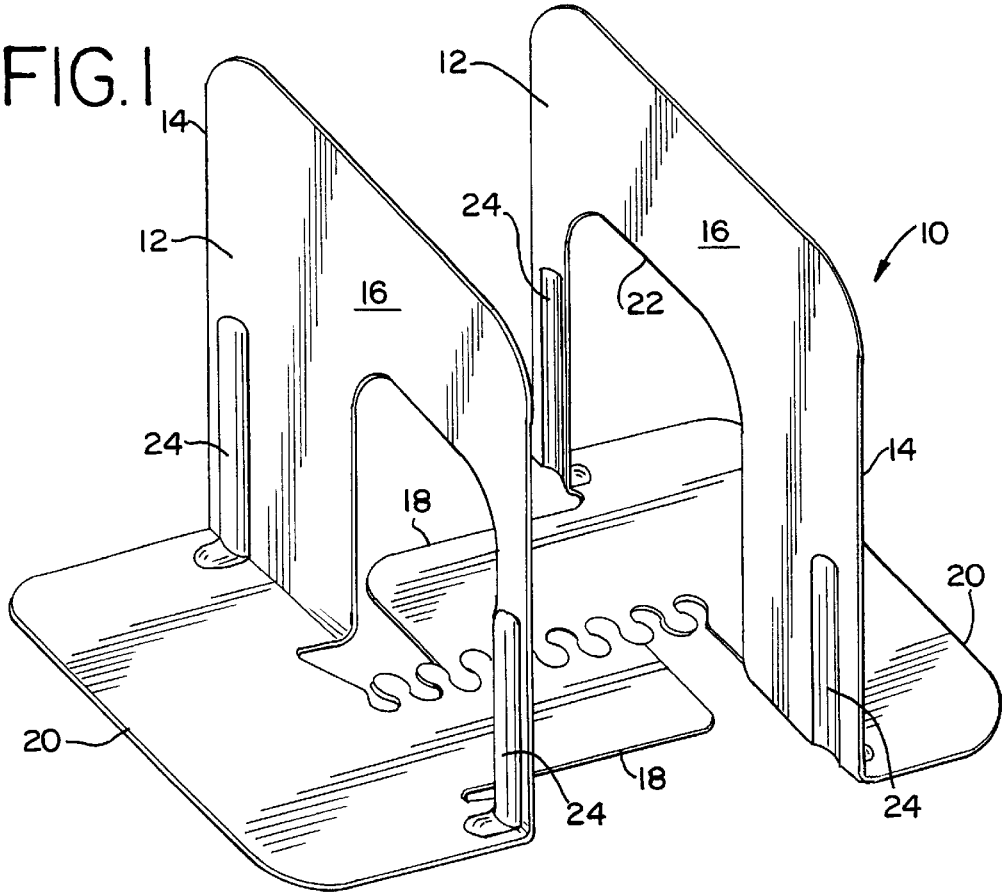
FIG. 1 is a perspective view of a pair of bookends according to the present invention showing the bookends in their interlocked condition.

Turning to the drawings, there is seen in FIG. 1 a book holder system 10 in accordance with the present invention. While the invention is described as a "book" holder system, it is readily appreciated that it is also suited for use with other objects, such as record albums, compact discs, file folders, etc.

Figure 4:
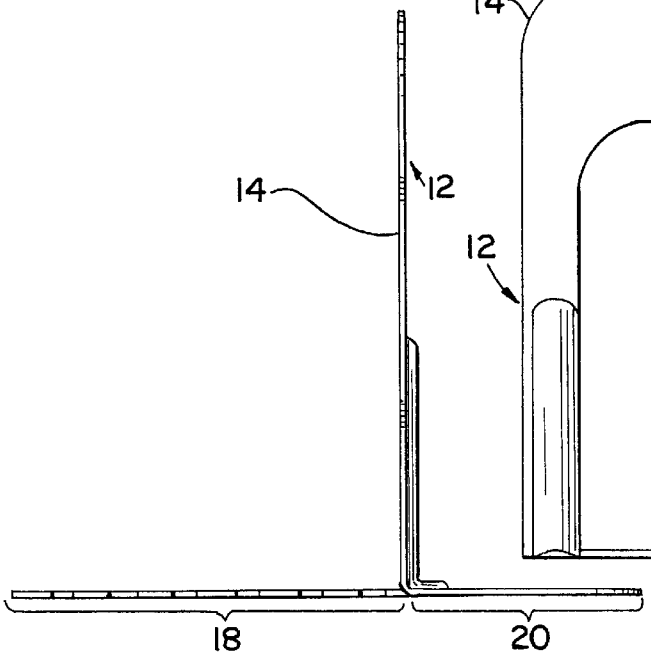
FIG. 4 is a front view showing the profile of one of the bookends of FIG. 1.
Figure 5:
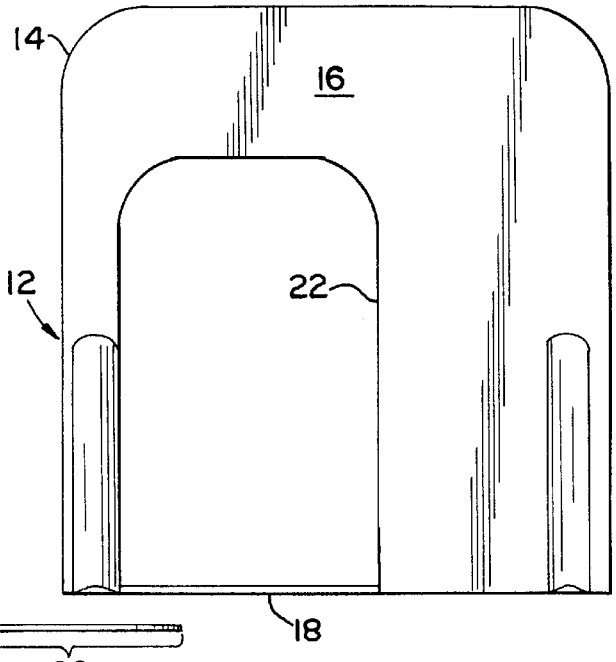
FIG. 5 is a side view taken from the left of FIG. 4.
Figure 6:
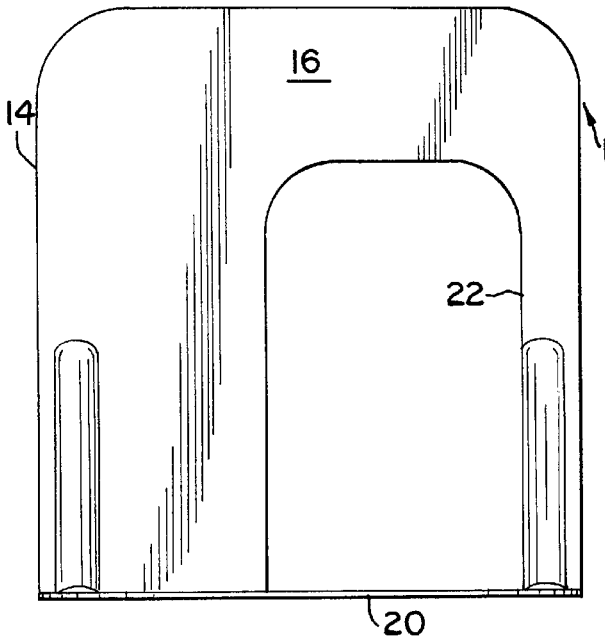
FIG. 6 is a side view taken from the right of FIG. 4.
Figure 7:
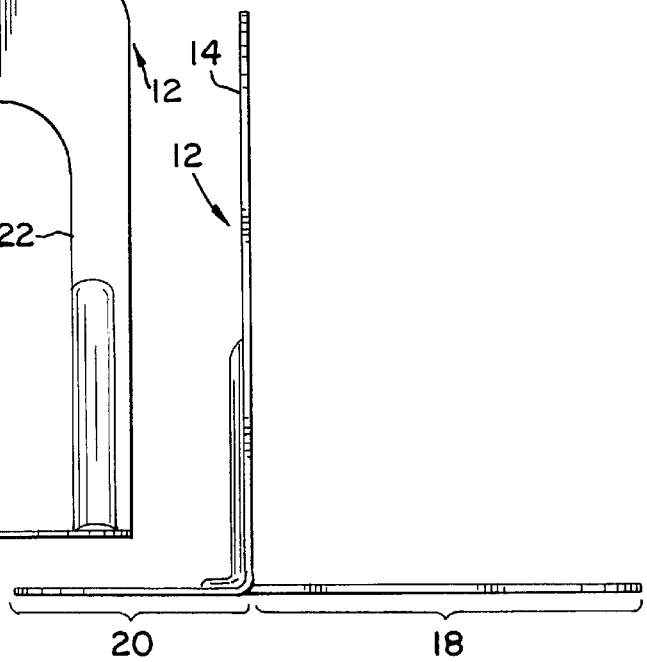
FIG. 7 is a back view of the bookend of FIG. 4.

The book holder system 10 comprises a pair of bookends 12, each, in profile, having an inverted T-shape, as best seen in FIGS. 4 and 7. Each bookend 12 has a vertically-extending leg 14 that presents a substantially planar, vertical surface 16 for engaging the object or objects to be held therebetween.

Each bookend 12 also includes a horizontal leg 18 that underlies the objects that are to be held between the bookends. The horizontal leg 18 of each bookend 12 may include a portion 20 that extends on the opposite side of the vertical leg 14 from the horizontal leg 18. However, such a portion 20 is not required by the present invention.

In practice, the two bookends 12 comprising the system 10 are identical in configuration and may be formed in a stamping operation from sheet metal. The vertical leg 14 includes a central cutout 22, from which the horizontal leg 18 is formed. The illustrated embodiment also includes a pair of stiffeners 24 on the vertical leg 18 which may be formed by stamping an elongated arcuate indentation into the peripheral edges of the vertical legs. After forming, the bookends are typically provided with a protective and/or decorative coating.

In keeping with the invention, the horizontal legs 18 include a series of alternating complimentary-shaped interlocking projections and recesses that, when mated (as shown in FIG. 1) prevent the vertical legs from moving either further apart or closer together (i.e., in a "longitudinal" direction), or laterally (i.e., either into or out of the surface on which the system 10 is placed). The interlocking projections and recesses may be disengaged only by relative vertical movement of one bookend with respect to the other. In other words, the interlocking members prevent movement of the bookends with respect to each other in two directions. This ensures that the bookends firmly hold the material held therebetween, and that the bookends will not creep apart over time. The bookends can be spread apart any distance and still have the benefit of the present invention as long as at least one projection on one of the bookends interlocks with one recess on the other bookend.

Figure 2:
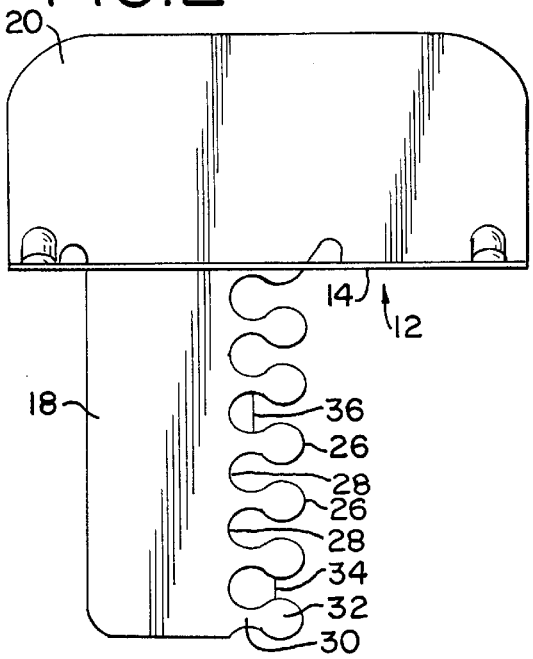
FIG. 2 is a top view of one of the bookends of FIG. 1.
Figure 3:
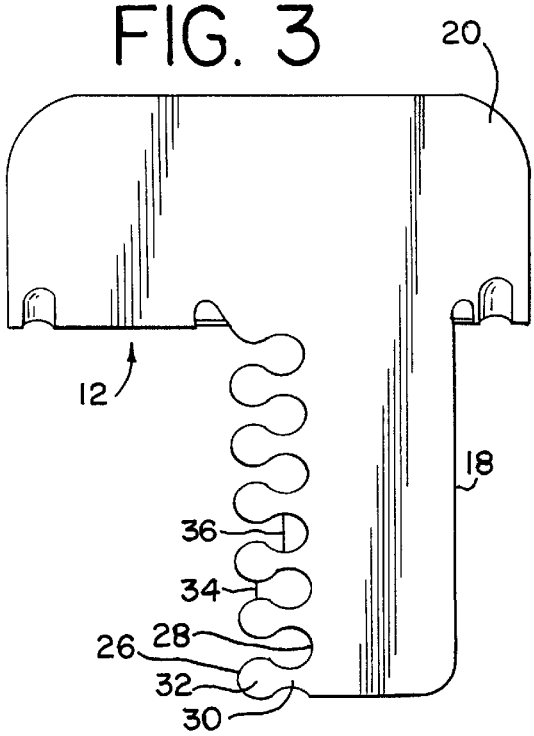
FIG. 3 is a bottom view of one of the bookends of FIG. 1.
Figure 8:
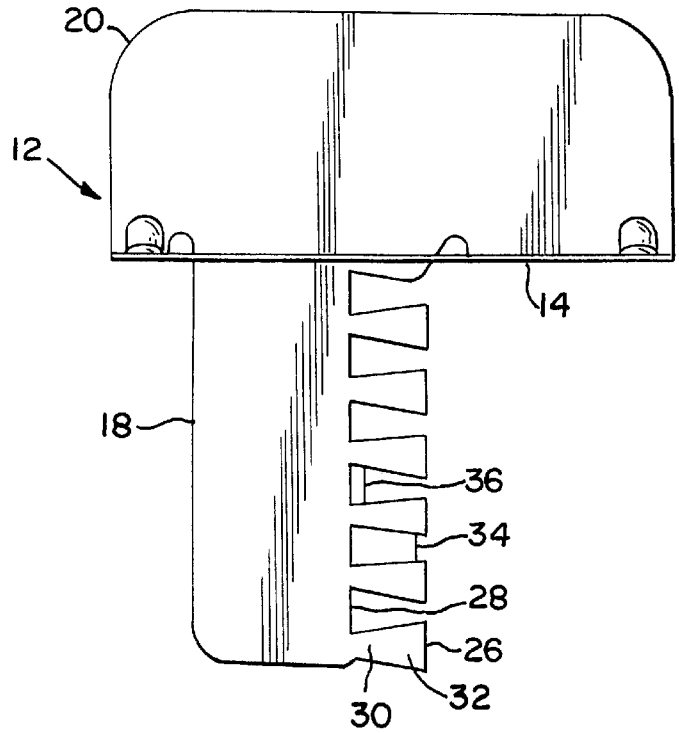
FIG. 8 is a top view of an alternate embodiment of a bookend according to the present invention in which the interlocking projections and recesses are dovetail-shaped.
Figure 9:
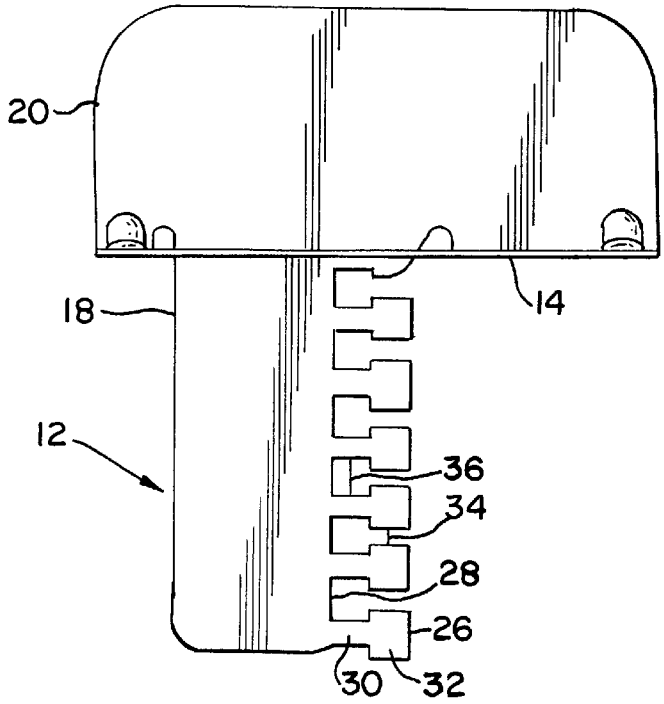
FIG. 9 is a top view of a further alternative embodiment in which the projections and recesses are T-shaped.

With reference to FIGS. 1–3, the projections 26 and recesses 28 are of a symmetrical, curvilinear shape. The symmetrical shape of the projections and recesses means that both bookends are identical, i.e., there is no male or female member. Each projection 26 has a narrow neck portion 30 and a relatively larger head portion 32. Each recess 28 has a narrow mouth 34 and a relatively larger interior 36. The necks 30 of the projections fit within the mouths 34 of the recesses 28, while the heads 32 of the projections fit within the interiors 36 of the recesses. Because the heads 32 of the projections are larger than the mouths 34 of the recesses, the two bookends 12 can be locked together (or unlocked from each other) only by relative movement in a vertical direction. Preferably, the projections and recesses are mirror images of each other, so that the projections and recesses precisely fit. As a consequence, each bookend 12 is identical to its mate. As can be readily appreciated, the complimentary-shaped interlocking projections and recesses may take a variety of forms, so long as the projections and the recesses are symmetrical and the head of the projection is larger than the mouth of the recess. For example, the projections and recess may be dovetail-shaped (FIG. 8) or T-shaped (FIG. 9).

Accordingly, a book holder system meeting all the objects of the present invention has been provided. While the invention has been described in terms of a preferred embodiment, there is no intent to limit the invention to the same. Instead, the scope of the invention is defined by the appended claims.

What is claimed:

1. A system for holding books comprising first and second bookends, each bookend providing a substantially planar vertical surface for engaging at least one object that is to be held between the bookends and having a horizontal leg that is adapted to underlie the objects being held between the vertical surfaces, the horizontal legs of the first and second bookends having a substantially linear array of complimentary-shaped interlocking projections and recesses along only one edge thereof, the projections permitting disengagement of the first bookend from the second bookend only when the first and second bookends are moved in a vertical direction with respect to each other.

2. The book holder system of claim 1 in which the projections are symmetrical in shape and have a narrow neck portion and a relatively larger head portion, the recesses are symmetrical in shape and have a narrow mouth and relatively larger interior, and the head portions of the projections being larger than the mouths of the recesses.

3. The book holder system of claim 2 in which the projections and recesses are T-shaped.

4. The book holder system of claim 2 in which the projections are dovetail-shaped.

5. The book holder system of claim 1 wherein the first and second bookends are an inverted T-shape with a vertical leg defining the vertical surface, and the vertical leg includes at least one stiffening portion integral with the vertical leg and extending in a vertical direction from the horizontal leg.

6. A system for holding books comprising first and second bookends, each bookend having an inverted T-shape with a vertical leg presenting a substantially planar vertical surface for engaging at least one object that is to be held between the bookends and a horizontal leg that is adapted to underlie the objects being held between the vertical surfaces, each vertical leg having at least one stiffening portion integral therewith extending in a vertical direction from the horizontal leg, the horizontal legs having complimentary, symmetrically-shaped interlocking projections and recesses, the projections having a narrow neck portion and a relatively larger head portion, the recesses having a narrow mouth and relatively larger interior, and the head portions of the projections being larger than the mouths of the recesses, the interlocking projections and recesses permitting disengagement of the first bookend from the second bookend only when the first and second bookends are moved in a vertical direction with respect to each other.

7. The book holder system of claim 6 in which the projections and recesses are T-shaped.

8. The book holder system of claim 6 in which the projections are dovetail-shaped.

* * * * *